US007070853B2

(12) United States Patent
Paul

(10) Patent No.: US 7,070,853 B2
(45) Date of Patent: Jul. 4, 2006

(54) LAYER SYSTEM COMPRISING A SUBSTRATE, AND AN OUTER POROUS LAYER

(75) Inventor: Uwe Paul, Ratingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/641,996

(22) Filed: Aug. 15, 2003

(65) Prior Publication Data

US 2004/0058185 A1 Mar. 25, 2004

Related U.S. Application Data

(63) Continuation of application No. PCT/EP02/13752, filed on Dec. 4, 2002.

(30) Foreign Application Priority Data

Jan. 15, 2002 (EP) ..... 02000874

(51) Int. Cl.

| | |
|---|---|
| ***B32B 3/10*** | (2006.01) |
| ***B32B 3/14*** | (2006.01) |
| ***B32B 3/26*** | (2006.01) |
| ***B32B 5/18*** | (2006.01) |

(52) U.S. Cl. ..... 428/304.4; 428/116; 428/117; 428/306.6; 428/307.7; 428/613; 428/689; 416/241 B; 416/241 R

(58) Field of Classification Search ..... 428/701, 428/702, 632, 633, 304.4, 306.6, 307.3, 697, 428/699, 613, 610, 116; 416/241 B, 241 R
See application file for complete search history.

(56) References Cited

U.S. PATENT DOCUMENTS

| | | | | |
|---|---|---|---|---|
| 4,639,388 | A * | 1/1987 | Ainsworth et al. | 428/117 |
| 5,024,884 | A * | 6/1991 | Otfinoski | 428/328 |
| 5,634,189 | A | 5/1997 | Rossmann et al. | |
| 5,720,597 | A | 2/1998 | Wang et al. | |
| 6,165,628 | A * | 12/2000 | Borom et al. | 428/610 |
| 6,235,370 | B1 * | 5/2001 | Merrill et al. | 428/116 |
| 6,294,260 | B1 * | 9/2001 | Subramanian | 428/469 |
| 6,299,935 | B1 | 10/2001 | Park et al. | |
| 6,670,046 | B1 * | 12/2003 | Xia | 428/469 |
| 6,770,325 | B1 * | 8/2004 | Troczynski et al. | 427/376.2 |

FOREIGN PATENT DOCUMENTS

EP 0 609 795 A1 8/1994

OTHER PUBLICATIONS

Guo-Zhang Cao et al.: "Pore Narrowing and Formation of Ultrathin Yttria-Stabilized Zirconia Layers in Ceramic Membranes by Chemical Vapor Deposition/Electrochemical Vapor Deposition", Journal of the American Ceramic Society, Sep. 1993, USA, Bd. 76, No. (, p. 2201-2208.

* cited by examiner

*Primary Examiner*—Jennifer McNeil
*Assistant Examiner*—Jason L. Savage

(57) ABSTRACT

Coating systems according to the prior art, wherein a ceramic layer is applied to a metallic layer of the coating system, the connection between metal and ceramic often being poor.

A coating system (20) according to the invention has a porous layer (4) in which a ceramic (7) is at least partly disposed, so that the connection between ceramic (7) and the metal of the porous layer (4) is improved.

10 Claims, 3 Drawing Sheets

LAYER SYSTEM COMPRISING A SUBSTRATE, AND AN OUTER POROUS LAYER

CROSS REFERENCE TO RELATED APPLICATIONS

This application is a continuation of International Application No. PCT/EP02/13752, filed Dec. 4, 2002 and claims the benefit thereof. The International Application claims the benefits of European application No. 02000874.4 flied Jan. 15, 2002, both applications are incorporated by reference herein in their entirety.

FIELD OF INVENTION

The invention relates to a coating system with a ceramic component in the coating layer.

BACKGROUND OF INVENTION

Coating systems consist of a substrate and at least one coating layer overlying said substrate. In gas turbine construction, for example, substrates must be protected from excessively high temperatures and/or corrosive attack. This protection can be provided by depositing metal with a honeycomb structure on the substrate, said structure being filled with a ceramic and said ceramic essentially performing the protective function. The metal of the honeycomb structure is used for mechanical stabilization of the ceramic. However, the mechanical connection of the ceramic and the internal surfaces of the honeycomb structure is not good, causing the ceramic to continually peel off.

U.S. Pat. No. 5,634,189 describes a system having a porous internal structure formed by spherical elements of various diameters, said porous inner core being surrounded by a non-porous outer shell. The outer shell is not used for protection. The porous core is used for filling the cavity in order to achieve a degree of mechanical stability, the thickness of the porous core, however, being less than that of the shell in order to save weight.

U.S. Pat. No. 5,720,597 shows a gas turbine blade, at least part of the interior of which has a foam section.

U.S. Pat. No. 6,299,935 discloses a method for producing a coating wherein a suspension consisting of foam and a metallic powder is deposited on the surface of a substrate.

However, all the known systems or methods have the disadvantage that the mechanical connection between metal and ceramic is inadequate.

SUMMARY OF INVENTION

The object of the present invention is therefore to demonstrate a coating system which improves the mechanical strength between metal and ceramic.

This object is achieved according to the invention by a coating system consisting of a substrate on which a porous layer having a porosity of at least 30 percent by volume is deposited, a ceramic being partially incorporated in the porous layer in the form of a coating or as ceramic particles. In comparison to a flat-faced contact surface, the honeycomb structure with the metallic surface and the ceramic deposited thereon provides many small curved surfaces which improve the mechanical bond between metal and ceramic by increasing the surface area and mechanical adhesion.

It is advantageous to use an open pore structure because this improves the penetration depth of ceramic into the porous layer so that the adhesion of the layer is increased still further.

The ceramic applied to the porous layer and at least partially incorporated in same can also constitute a mixture of various ceramic materials in order to selectively adjust required characteristics.

The porous layer can be filled at least in certain areas with ceramic in such a way that it is virtually non-porous in these areas, so that a virtually non-porous ceramic layer is achieved in the porous coating layer in order to exploit the advantages of the ceramic in respect of heat resistance.

For example, an additional protective ceramic layer of the type known from heat insulation layers of gas turbine blades can be deposited on the ceramic in the porous layer or over the porous layer in order to protect the ceramic in the porous layer from oxidation by providing an additional coating.

BRIEF DESCRIPTION OF THE DRAWINGS

Exemplary embodiments are explained in greater detail in FIGS. 1 to 7.

DETAILED DESCRIPTION OF INVENTION

Figure 1A:
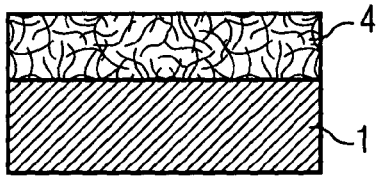
FIGS. 1*a, b* show a substrate with a porous layer and a ceramic in the porous layer.

FIG. 1*a* shows a substrate 1, e.g. made of metal, specifically a superalloy, for a gas turbine blade onto which a porous layer 4 has been deposited. The porous layer 4 can be made of metal or ceramic.

The porous structure is schematically represented by the line-strokes which are intended to represent the individual walls surrounding the pores in the porous layer 4. The porosity is at least thirty (30) percent by volume. An open pore structure is particularly advantageous, i.e. there are connection paths from the outer surface of the porous layer 4 to its underside which faces the substrate 1, as is known, for example, from use in filter systems. A ceramic can be incorporated particularly well into the porous layer.

Figure 1B:
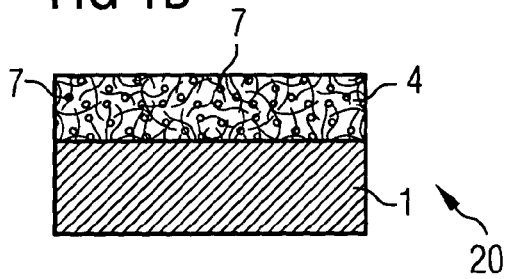

FIG. 1*b* shows a coating system according to the invention wherein a ceramic 7 is present in the porous layer 4. The ceramic 7 can consist of a single ceramic material or a mixture of various ceramic materials or take the form of ceramic particles. Metallic additions or coatings are likewise possible.

Figure 2A:
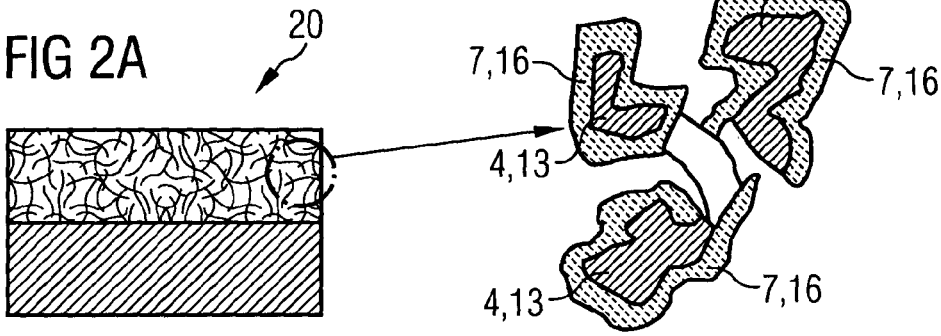
FIG. 2*a* shows a substrate with a porous layer, said porous layer being coated on its inner surfaces with a ceramic layer (FIG. 2*b*)

FIG. 2*a* shows another exemplary embodiment of a coating system 20 according to the invention wherein no individual ceramic particles 7 are identifiable (FIG. 2*a*) because the pore walls 13 of the porous layer 4 have been coated with a ceramic layer 16 (FIG. 2*b*). Thus, for example, the inner surfaces of the pores of the porous layer 4 are completely covered with a ceramic 16.

Figure 3:
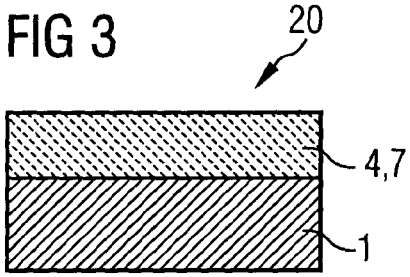
FIG. 3 shows a substrate with a porous layer which has been rendered virtually non-porous by the ceramic.

FIG. 3 shows another exemplary embodiment of a coating system 20 implemented according to the invention. Onto the substrate 1 is deposited a porous layer 4 whose pores are filled with the ceramic 7 to produce a non-porous layer.

Figure 4:
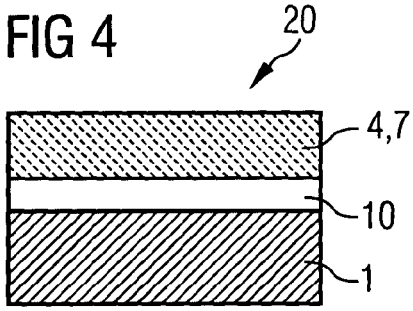
FIG. 4 shows another exemplary embodiment of the invention.

FIG. 4 shows that at least one additional intermediate layer 10 can be present between the substrate 1 and the porous layer 4.

Figure 5:
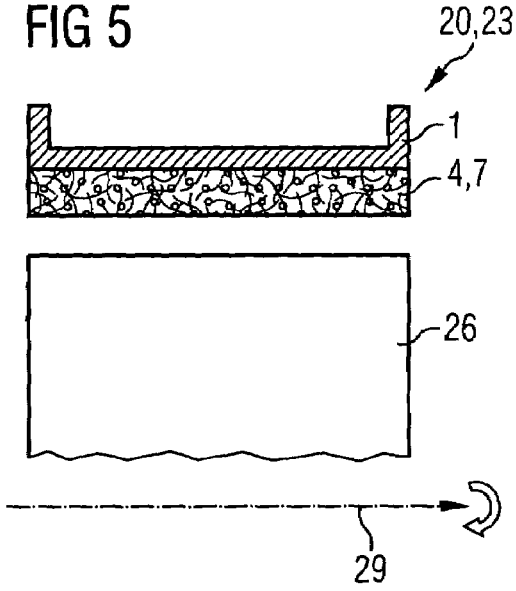
FIG. 5 shows a typical example of a coating system of this kind, FIGS. 6*a, b* show manufacturing operations for producing a coating system according to the invention, FIGS. 7, 8, 9*a, b* show further exemplary embodiments for producing a coating system according to the invention, and FIG. 10*a, b* show further exemplary embodiments of the invention.

FIG. 5 shows another typical application of the coating system 20 according to the invention. The coating system 20 forms part of a gas turbine casing 23 which encloses e.g. turbine blades 26 installed downstream of a burner in a gas turbine. The rotational axis of the turbine blade 26 is indicated with 29. The coating system 20 according to the invention forms a seal between gas turbine casing 23 and turbine blade 26 and replaces the honeycomb structure described above. Other typical applications may be found for gas turbine blades and heat shielding elements.

Figure 6A:
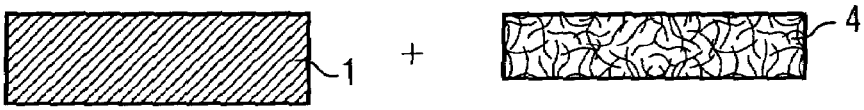
Figure 6B:
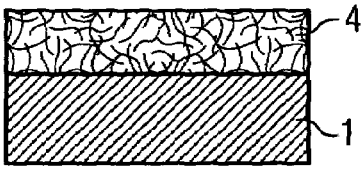

FIGS. 6*a, b* show the manufacturing steps for producing a coating system according to the invention 20. The substrate 1 is interconnected with a prefabricated porous component 4 by means of a joining technique (FIG. 6*b*). This can be performed e.g. by welding, diffusion welding or diffusion soldering. Other joining techniques are possible.

Figure 7:
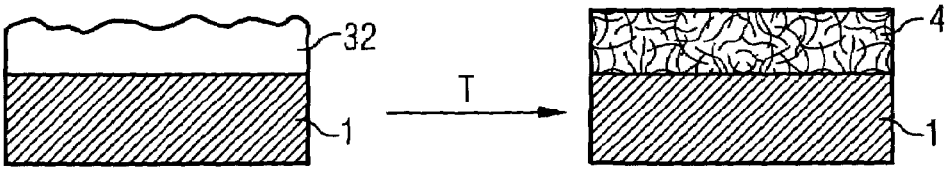

FIG. 7 shows another method for producing a coating system 20 according to the invention. Onto the substrate 1 a suspension 32 is deposited which is converted into a porous layer 4 during treatment at a temperature T. This can take place in the known manner in that the suspension 32 contains a metal powder and an activator which is gasified during heat treatment and foams the suspension containing the metal, the metal particles then being e.g. sintered together at elevated temperature to form the porous layer 4, and a good connection with the substrate 1 simultaneously taking place. Other manufacturing methods for producing porous, specifically foam-like structures can be used here, such as precision casting, for example.

Figure 8:
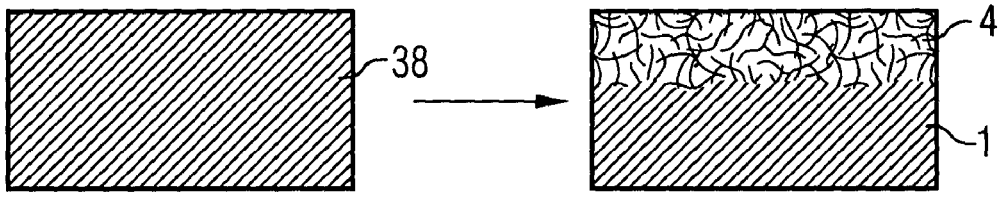

FIG. 8 shows another exemplary embodiment for producing a coating system 20 according to the invention. This can be performed, for example, by first casting the material for the substrate 1 in one casting process and then continuously casting a metal or an alloy having a porous structure or a mixture of metal and ceramic to produce, on the substrate 1, a porous metallic layer 4 possibly tightly filled with ceramic. A substrate 1 and a porous layer 4 can also be formed from a blank 38 by means of an intermediate treatment.

In order to definitively produce the coating system 20 according to the invention, it is often still necessary to incorporate the ceramic 7 into the porous layer 4. This can be performed by a coating device 35 (FIG. 9*a*) by means of plasma spraying, for example, so that a ceramic coating 16 is produced in the porous layer 4. The coating process can be continued in such a way that not only the walls 13 of the porous layer are coated, but the pore structure is also at least partially closed in order to achieve a non-porous layer.

Figure 9A:
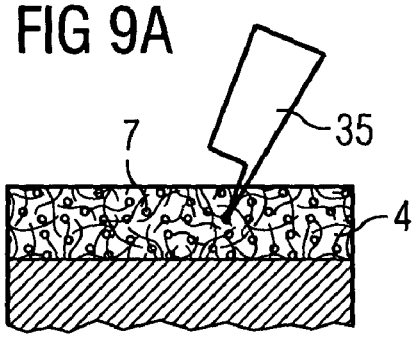

A ceramic suspension with ceramic particles can also be incorporated, more specifically injected, into the porous layer 4 by a spray nozzle 35 (FIG. 9*a*). In a subsequent process step the carrier medium of the suspension is vaporized so that the ceramic particles 7 are left behind and combine with the metallic walls 13 of the porous layer 4 after a heat treatment.

Figure 9B:
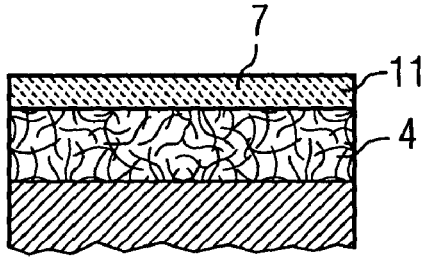

The porous layer 4 can also be completely filled with the ceramic 7 only in an upper area 11 (FIG. 9*b*).

Figure 10A:
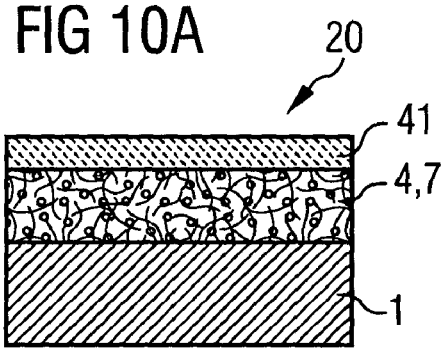
Figure 10B:
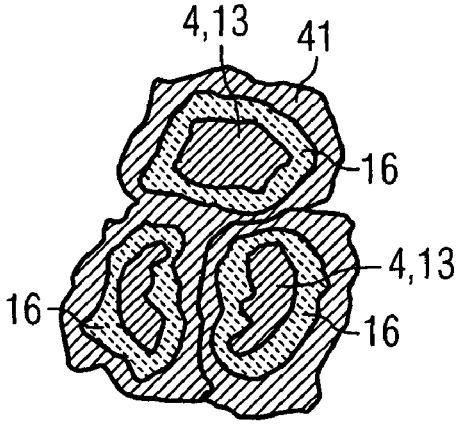

The porous layer 4 is advantageously filled with a ceramic 7 exhibiting good mechanical properties at elevated temperatures and serving as a thermal barrier. However, in order to protect this ceramic and also the metallic walls of the porous layer 4 from oxidation and/or corrosion and/or heat, yet another protective ceramic layer 41 can be applied to the porous layer 4 (FIG. 10*a*) or over the ceramic particles 7 or the ceramic layer 16 within the porous layer 7 (FIG. 10*b*).

The invention claimed is:

1. A coating system, comprising:

a substrate; and an outer porous layer with a porosity of at least 30 percent by volume which is disposed on the substrate comprising randomly oriented metal walls surrounding and defining a plurality of pores in the layer and adapted to provide a connection path from the outer surface of the porous layer to an underside of the layer that faces the substrate, the porous layer being substantially filled with a ceramic at the interface of the porous layer and the substrate, the porous layer adapted to promote adhesion between the porous layer and the substrate.

2. The coating system according to claim 1, wherein the ceramic is a mixture of various ceramic materials.

3. The coating system according to claim 1, wherein another ceramic layer is applied on top of the porous layer.

4. The coating system according to claim 1, wherein the porous layer is not firm, having cavities and capable of absorbing a ceramic material.

5. The coating system according to claim 1, wherein the substrate is metallic.

6. The coating system according to claim 5, wherein the metallic substrate is a nickel based superalloy.

7. The coating system according to claim 1, wherein the ceramic substantially fills the entire porous layer.

8. The coating system according to claim 1, wherein the porous layer is made of ceramic.

9. The coating system according to claim 1, wherein there is an additional layer between the substrate and the porous layer.

10. A method for producing a coating system, compnsing:

providing a substrate;

disposing an outer porous layer with a porosity of at least 30 percent by volume on the substrate, the porous layer comprising randomly oriented individual metal walls surrounding and defining a plurality of pores in the layer and adapted to provide a connection path from the outer surface of the porous layer to an underside of the layer that faces the substrate; and substantially filling the porous layer with a ceramic at the interface of the porous layer and the substrate, the porous layer adapted to promote adhesion between the porous layer and the substrate.

* * * * *